US006769787B2

(12) United States Patent
Ferguson et al.

(10) Patent No.: US 6,769,787 B2
(45) Date of Patent: Aug. 3, 2004

(54) FLASHLIGHT

(75) Inventors: Mark A. Ferguson, Memphis, NY (US); Scott W. Osiecki, Skaneateles, NY (US); Joseph P. Gardner, North Ridgeville, OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 124 days.

(21) Appl. No.: 09/939,546

(22) Filed: Aug. 24, 2001

(65) Prior Publication Data

US 2002/0041493 A1 Apr. 11, 2002

Related U.S. Application Data

(60) Provisional application No. 60/239,602, filed on Oct. 11, 2000.

(51) Int. Cl.[7] ..... F21L 4/04

(52) U.S. Cl. ..... 362/203; 362/112; 362/196; 362/205

(58) Field of Search ..... 362/202, 203, 362/196, 208, 205, 112

(56) References Cited

U.S. PATENT DOCUMENTS 1,365,636 A * 1/1921 Boltshauser ..... 362/196
3,341,701 A * 9/1967 Moore et al. ..... 362/191

* cited by examiner

*Primary Examiner*—Stephen Husar
(74) *Attorney, Agent, or Firm*—Stewart A. Fraser

(57) ABSTRACT

A light device having a battery and lamp housing and a hinged top door. Batteries and a lamp holder are located within the housing and are accessible by opening the hinged top door. As the hinged top door is opened, a cam surface that holds the batteries in tight contact with the lamp holder moves away from the batteries, thereby releasing the tension holding the batteries in place within the housing. The batteries can therefore be easily loaded and unloaded. Likewise, as the hinged top door is closed, the tension holding the batteries in place is reapplied to the batteries to create a circuit for powering a lamp engaged with the lamp holder. Furthermore, the lamp engaged with the lamp holder is also accessed through the hinged top door.

52 Claims, 5 Drawing Sheets

FLASHLIGHT

CROSS-REFERENCE TO RELATED APPLICATION

The present invention claims priority to Provisional Patent Application Serial No. 60/239,602, filed on Oct. 11, 2000 entitled PORTABLE LIGHT DEVICE WITH TRIGGER-RELEASED, HINGED DOOR FOR ACCESSING BATTERIES AND A LAMP.

BACKGROUND OF THE INVENTION

The present invention relates to lighting devices, and in particular to a portable light device with a hinged door for accessing batteries and a lamp.

Lighting devices are used extensively as flashlights for lighting dark areas, as signaling lamps, for safety, etc.

Heretofore, flashlights have typically included a cylindrical housing with a closed end and an opposite open threaded end. Batteries are inserted into the cylindrical housing and a lamp holder is threaded over the open threaded end of the housing. A switch, usually located on the outer circumference of the housing, can then be activated to alternatively turn the flashlight on and off. The lamp holder typically includes a spring that is biased against the batteries in the housing as the lamp holder is screwed onto the housing. The spring also serves as an electrical contact for powering a lamp in the lamp holder.

Another typical flashlight includes a housing wherein the batteries are side loaded into the housing. In this flashlight, at least one of the electrical contacts is a spring that is stationary relative to the housing. The batteries are inserted into the housing by forcing the contacts apart. The lamp holder for these flashlights are typically threaded onto the body such that the lamp holder can be unscrewed in order to change the lamp in the lamp holder or integral with the body such that the lamp can not be changed.

SUMMARY OF THE INVENTION

One aspect of the present invention is to provide a light device including a battery housing and a door. The battery housing defines an interior space adapted to accept batteries and is adapted to accept a lamp. The door is pivotally connected to the battery housing, with the door having an open position allowing access to the interior space of the battery housing and a closed position for enclosing the interior space of the battery housing. The door includes an electrical cam. The electrical cam is configured to contact batteries in the battery housing when the door is pivoted to the closed position to thereby create a circuit for powering the lamp. The electrical cam is also configured to move away from batteries in the battery housing when the door is pivoted to the open position to thereby allow the batteries to be removed from the interior space of the battery housing.

Another aspect of the present invention is to provide a light device including a housing and a hinged top door, the housing including a cavity configured to retain batteries therein. The housing further includes a lamp holder configured to retain a lamp. The hinged top door is connected to the housing. The hinged top door includes an open position for allowing access to the cavity and a closed position for enclosing the cavity. The hinged top door also includes a cam adapted to hold batteries in the cavity in tight contact with the lamp holder when the hinged top door is in the closed position. The cam is configured to move towards the batteries as the hinged top door is moved to the closed position, thereby applying tension to the batteries to hold the batteries in place to create a circuit for powering the lamp engaged with the lamp holder. The cam is also configured to move away from the batteries as the hinged top door is moved to the open position, thereby releasing the tension holding the batteries in place within the housing and allowing the batteries to be easily loaded and unloaded.

Yet another aspect of the present invention is to provide a light device including a housing, a cover, a reflector, a lamp holder and a door. The housing defines an interior space adapted to accept batteries. The cover is fixed to the housing and allows light to at least partially pass therethrough. The reflector is also fixed to the housing. The lamp holder is adapted to retain a lamp. The lamp holder is removably connected to the housing within the interior space of the housing and is configured to be positioned adjacent the reflector of the lamp enclosure when in the housing to position the lamp between the reflector and the lens. The door has an open position allowing access to the interior space of the housing and a closed position for enclosing the interior space of the housing. The lamp holder is accessible from the interior space of the housing, thereby allowing the lamp to be removed from the housing when the door is in the open position.

In another aspect of the present invention, a light device is provided, wherein the light device includes a housing and a hinged top door. The housing has a first end, a second end and a U-shaped bottom extending between the first end and the second end. The first end, second end and U-shaped bottom define an interior space adapted to accept batteries, the housing including a reflector and a cover at the first end. The housing is configured to accept a lamp between the cover and the reflector. The hinged top door is pivotally connected to the housing and is configured to enclose the batteries within the interior space. The hinged top door includes an open position for allowing access to the cavity and a closed position for enclosing the cavity. The hinged top door also includes a palm surface and the housing includes a grip surface and a trigger detent, with the trigger detent being located between the grip surface and the first end of the housing, thereby ergonomically accepting a hand of a user of the light device with fingers of a user of the light device on the grip surface and a palm of the user enclosed around the palm surface of the hinged top door. The trigger detent is configured to allow a user of the light device to readily actuate the trigger detent with an index finger of the user to thereby alternatively turn the lamp on and off by closing and opening, respectively, a circuit between the lamp and the batteries.

Accordingly, the light devices of the present invention therefore include an ergonomically shaped housing and top door with easy and intuitive lamp and battery access. The light devices are efficient in use, economical to manufacture, capable of a long operable life, and particularly adapted for the proposed use.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
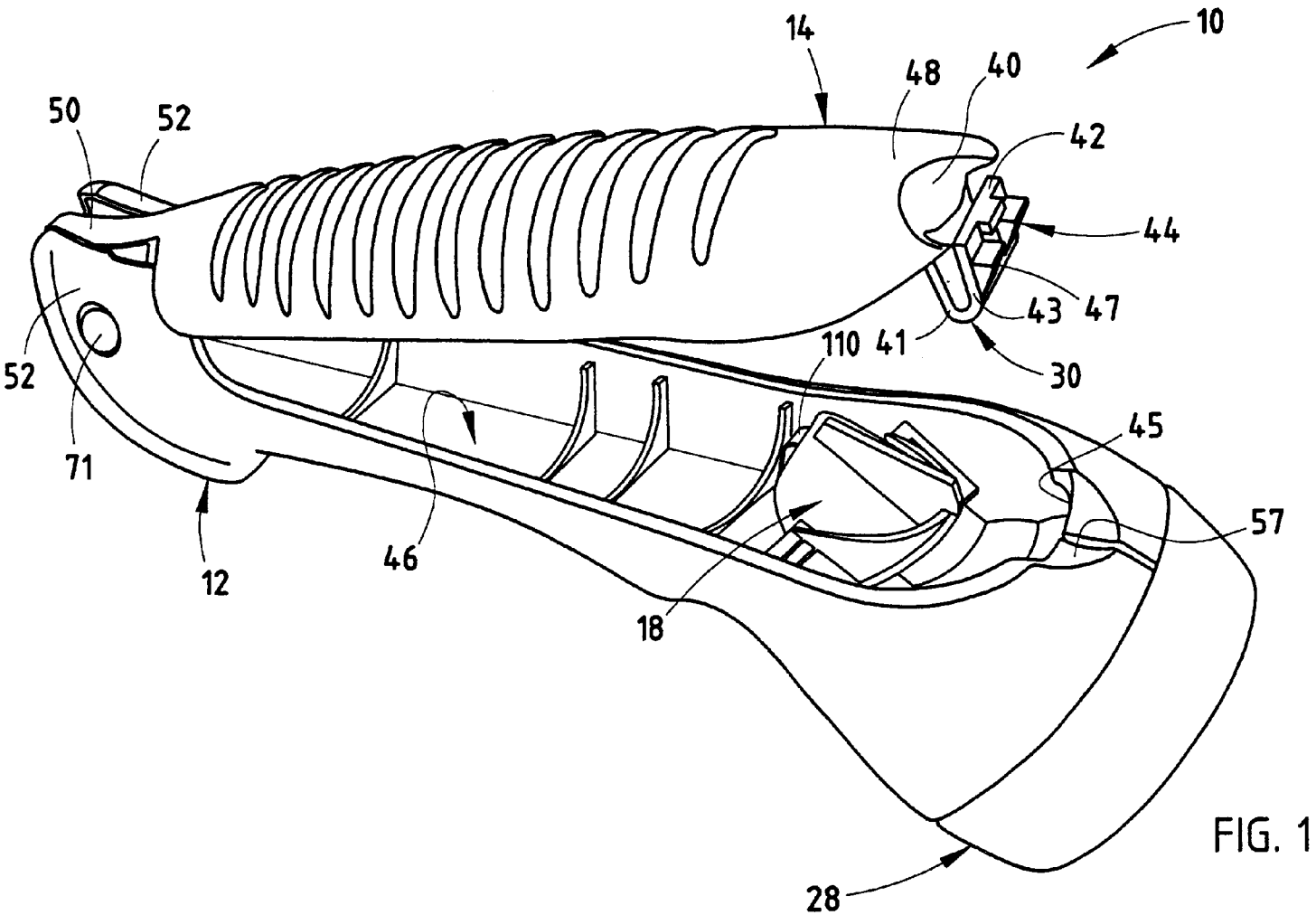
FIG. 1 is perspective view of a light device having a lamp housing embodying the present invention with a hinged top door in a partially open position.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
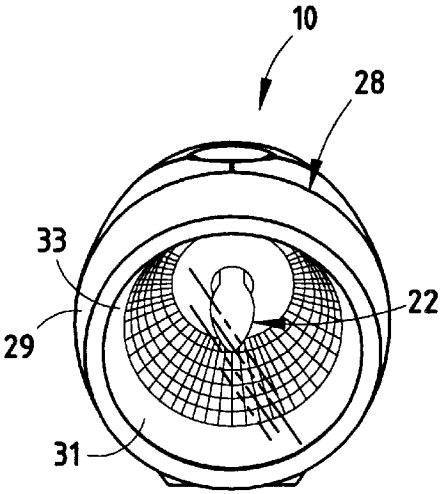
FIG. 5 is a front perspective view of the light device embodying the present invention with the hinged top door in the closed position.

The reference number 10 (FIGS. 1–6) generally designates a light device embodying the present invention. In the illustrated example, the light device 10 includes a battery and lamp housing 12 and a hinged top door 14. Batteries (not shown) and a lamp holder 18 are located within the housing 12 and are accessible by opening the hinged top door 14. The hinged top door 14 includes a cam 20 at its hinged end holding the batteries in tight contact with the lamp holder 18 when the hinged top door 14 is closed. As the hinged top door 14 is opened, the cam 20, which holds the batteries in tight contact with the lamp holder 18, moves away from the batteries, thereby releasing the tension holding the batteries in place within the housing 12. The batteries can therefore be easily loaded and unloaded. Likewise, as the hinged top door 14 is closed, the tension holding the batteries in place is reapplied to the batteries to create a circuit for powering a lamp 22 (See FIG. 5) engaged with the lamp holder 18. Furthermore, as explained below, the lamp 22 engaged with the lamp holder 18 is also accessed through the hinged top door 14.

Figure 6:
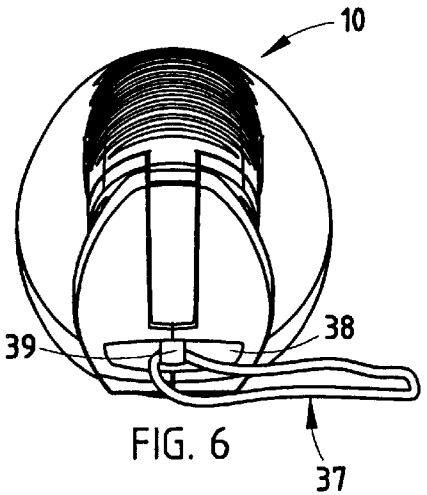
FIG. 6 is a rear view of the light device embodying the present invention with the hinged top door in the closed position.

In the illustrated example, the battery and lamp housing 12 (FIGS. 1–8) includes an interior cavity 46, a grip surface 24, a detent trigger 26, a lamp enclosure 28 and a pair of struts 52. As seen in FIG. 3, the grip surface 24 is located about the exterior of the housing 12 and is configured to ergonomically accept the fingers of the user of the light device 10 with the palm of the user enclosed around the hinged top door 14 of the light device 10. The detent trigger 26 is located forward of the grip surface 24 and allows the user of the light device 10 to readily actuate the trigger 26 with the user's index finger to thereby alternatively turn the lamp 22 on and off by closing and opening, respectively, a circuit between the lamp 22 and the batteries. The illustrated struts 52 are parallel and, as explained in more detail below, define an opening 53 therebetween for accepting the hinged top door 14. The struts 52 extend from and define the back of the internal cavity 46. As seen in FIG. 6, the housing 12 also preferably includes a rear notch 38 having a vertical retaining bar 39 spanning a vertical height of the notch 38. The retaining bar 39 retains a wrist rope 37 within the notch 38 to thereby connect the wrist rope 37 to the housing 12.

Figure 7:
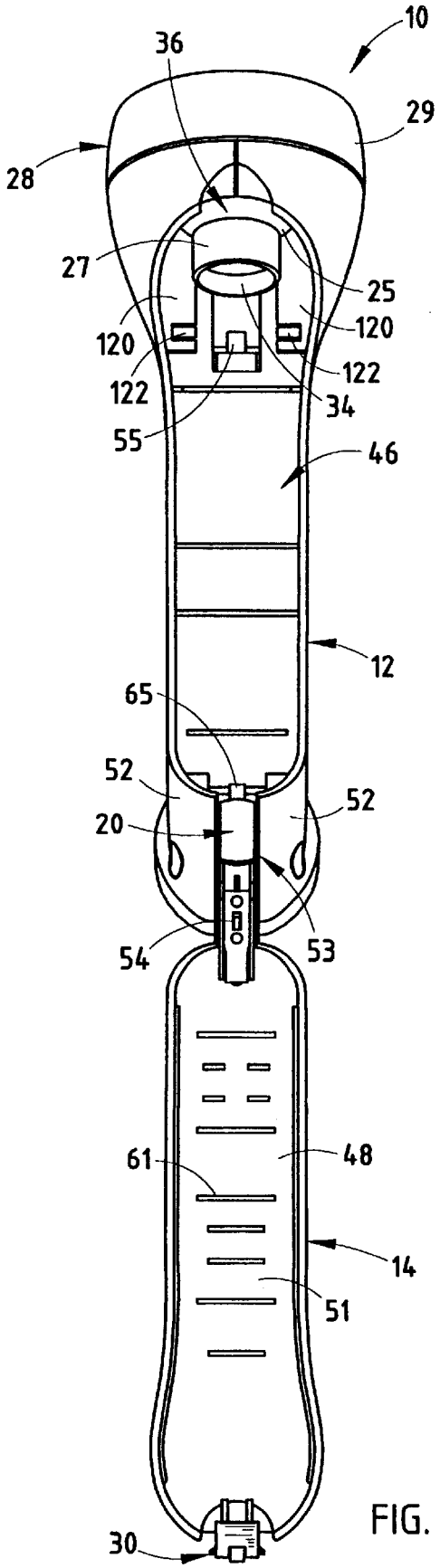
FIG. 7 is a top view of the light device embodying the present invention with the lamp housing removed and the hinged top door in the open position.
Figure 8:
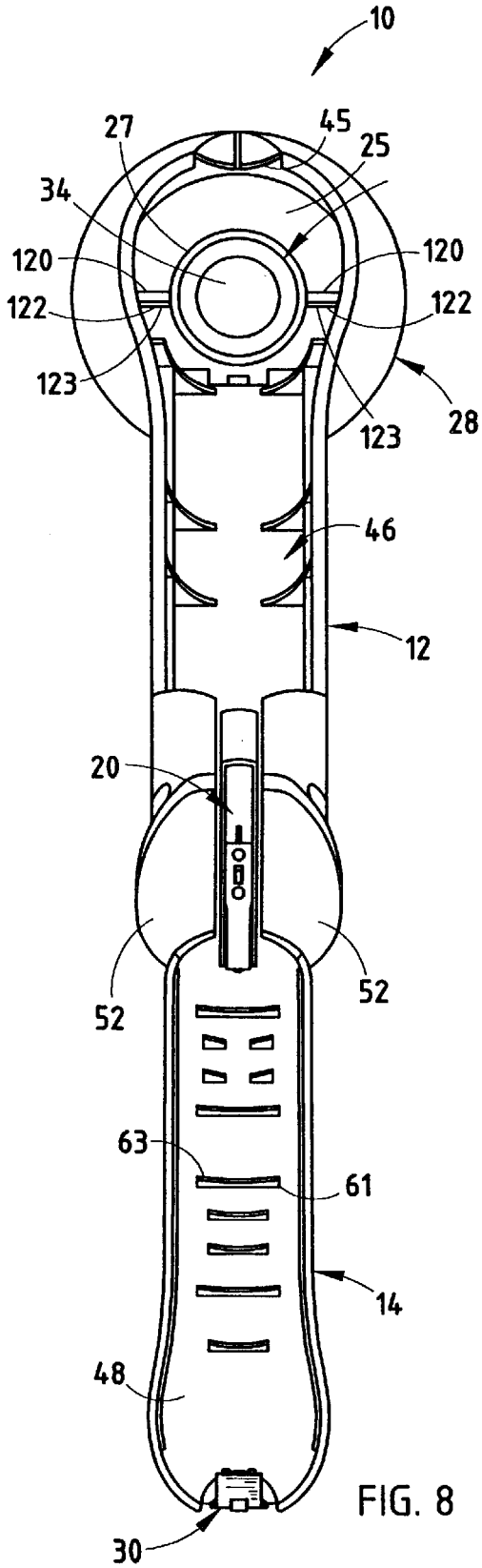
FIG. 8 is a rear perspective view of the light device embodying the present invention with the lamp housing removed and the hinged top door in the open position.
Figure 10:
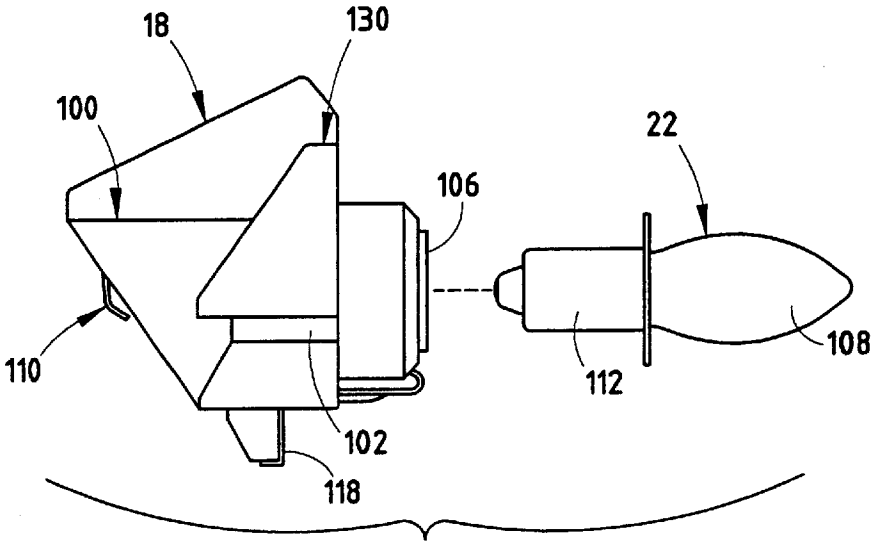
FIG. 10 is a side exploded view of the lamp holder and the lamp embodying the present invention.
Figure 12:
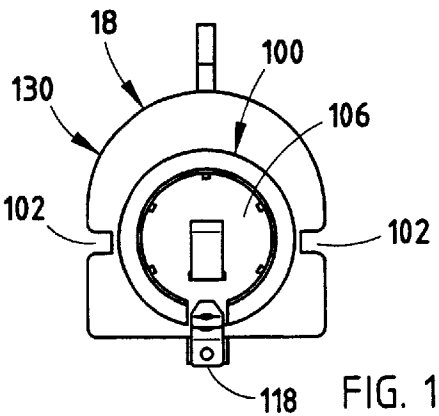
FIG. 12 is a front view of the lamp holder embodying the present invention.
Figure 9:
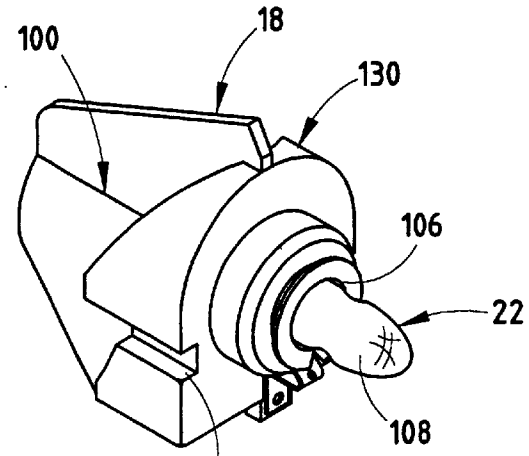
FIG. 9 is a perspective view of the lamp holder and a lamp embodying the present invention.
Figure 11:
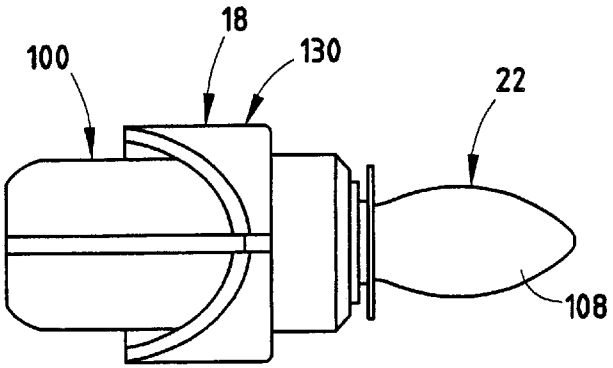
FIG. 11 is a top view of the lamp holder and the lamp embodying the present invention.

The illustrated lamp enclosure 28 (FIG. 5) of the housing 12 is located at a front end of the housing 12 and includes a bezel 29 encircling a concave reflective surface 31 and a disk-shaped transparent or translucent cover 33. The concave reflective surface 31 and the cover 33 of the lamp enclosure 28 are similar to the reflective surfaces and covers or lenses of flashlights found in the prior art. Unlike prior art light devices, however, the lamp enclosure 28 is integral with the housing 12. As seen in FIGS. 7 and 8, an interior portion 36 of the lamp enclosure 28 within the interior cavity 46 includes a conical portion 25 and a tubular portion 27 with a central opening 34 for reception of the lamp 22.

In the illustrated example, the hinged top door 14 (FIGS. 1–4, 7 and 8) includes an enclosure shell 48 for enclosing the interior cavity 46 of the housing 12 and a pivot leg 50 pivotally connected to the housing 12. The enclosure shell 48 has a substantially inverted U-shaped cross-section and defines an upward facing top palm surface 49 (see FIG. 3). A user of the light device 10 holds the light device 10 by wrapping his or her palm about the palm surface 49 and gripping the grip surface 24 with his or her fingers and thumb. The wrist rope 37 is adapted to be placed around the wrist of a user of the light device 10 to carry the light device 10 when the grip surface 24 and the palm surface 49 are not grasped by the user of the light device 10. A lower surface 51 of the enclosure shell 48 accepts the batteries when the hinged top door 16 is in the closed position and includes a plurality of depending flanges 61 having a concave bottom edge 63 for holding the batteries in position. The pivot leg 50 extends from the back of the enclosure shell 48 and is located in opening 53 between the two struts 52 located at the back of the housing 12. A pivot pin 71 extends through an opening in the pivot leg 50 and into the struts 52 to allow the pivot leg 50 to rotate between the struts 52. The pivot leg 50 includes the cam 20. The cam 20 has a first electrical contact strip 54, which is electrically conductive. The first electrical contact strip 54 is configured to contact one of the batteries and a mating second contact 65 in the housing 12 located between the struts 52. A circuit is formed between the first electrical contact strip 54, the mating contact 65 in the housing 12, a conductor (not shown) running from the mating contact 65 and through the housing 12 that is selectively interrupted by the trigger 26, to a third electrical contact 55 (see FIGS. 7 and 8) positioned adjacent the lamp holder 18. The circuit is closed when the hinged top door 14 is in the closed position and opened when the hinged top door 14 is in the open position.

Figure 2:
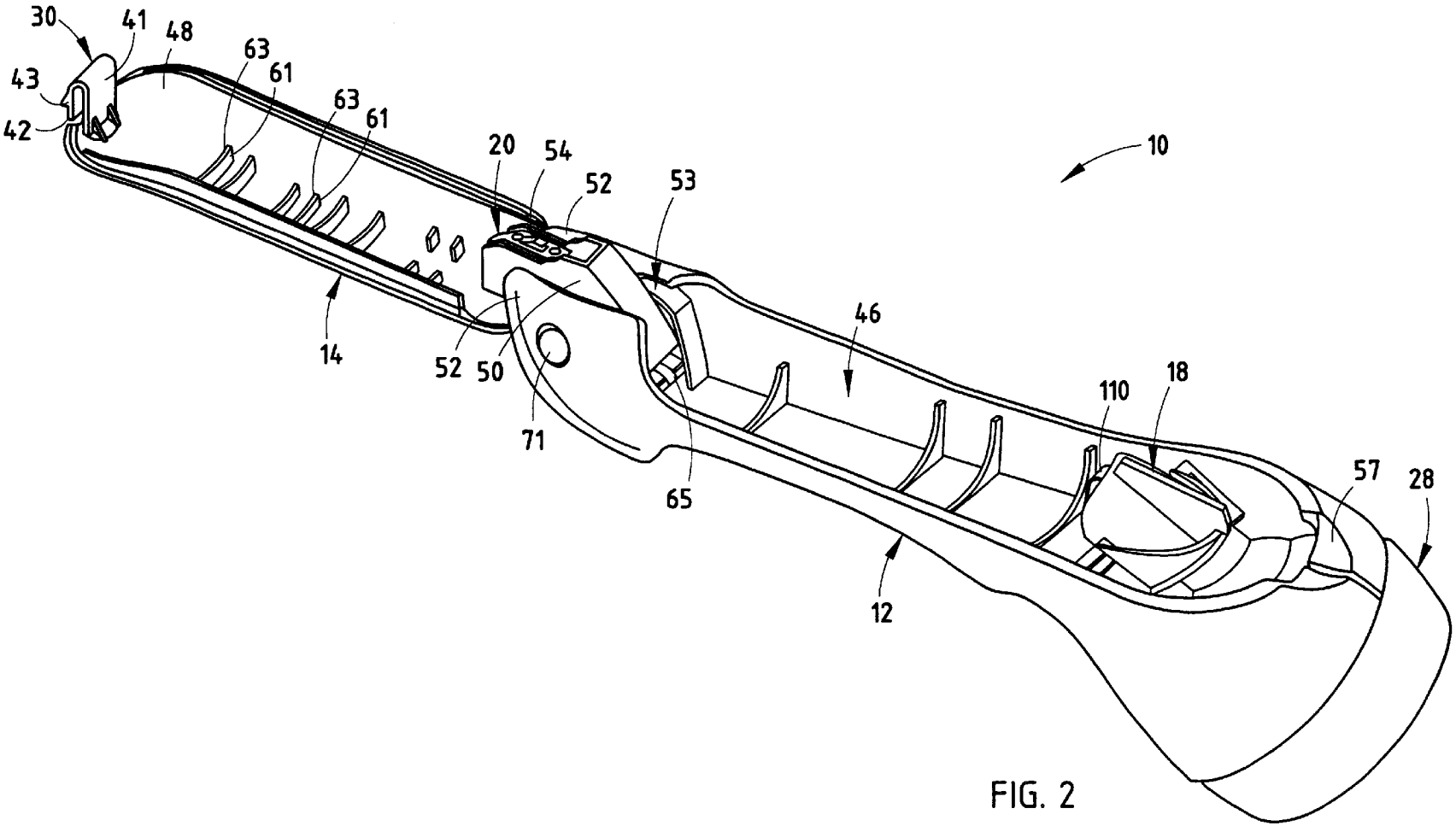
FIG. 2 is perspective view of the light device having the lamp housing embodying the present invention with the hinged top door in an open position.
Figure 3:
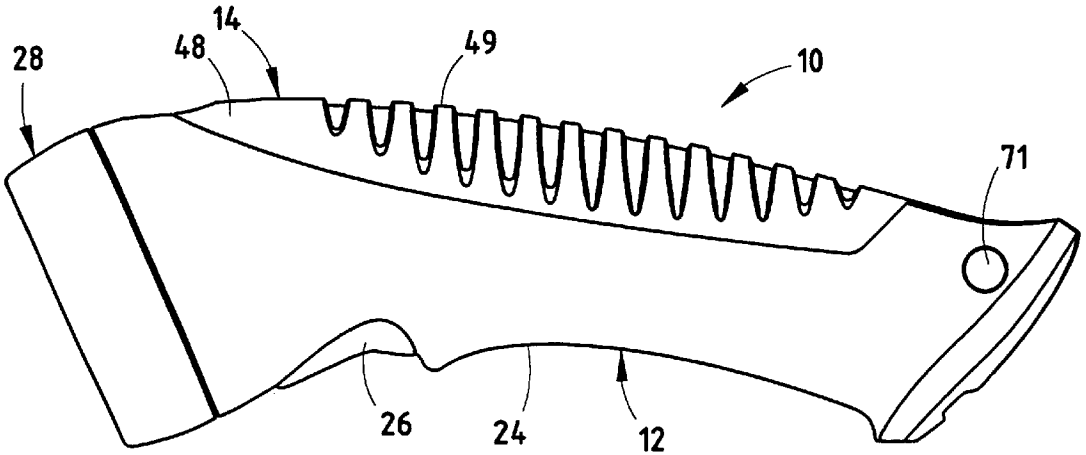
FIG. 3 is side view of the light device embodying the present invention with the hinged top door in a closed position.
Figure 4:
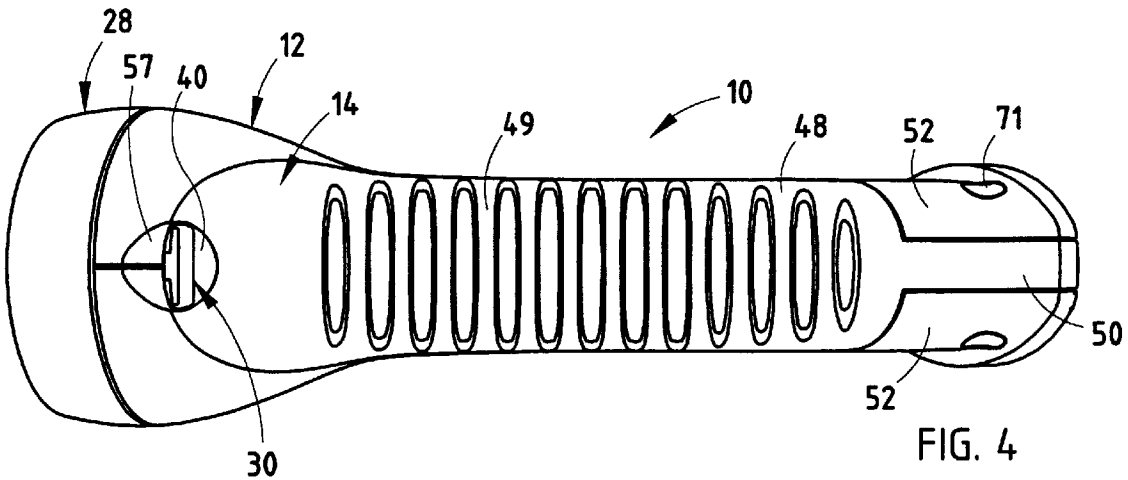
FIG. 4 is a top view of the light device embodying the present invention with the hinged top door in the closed position.

The illustrated hinged top door 14 also includes a U-shaped spring actuated locking mechanism 30 (FIGS. 1, 2 and 4). The U-shaped spring actuated locking mechanism 30 has a first leg 41 connected to a first semi-concave portion 40 of the hinged top door 14 at a front end of the hinged top door 14. A second leg 43 of the U-shaped spring actuated locking mechanism 30 includes a thumb tab 42 and a latch 44. The latch 44 is configured to engage a bottom surface 45 of top part of the housing 12 behind the lamp enclosure 28 and underneath a second semi-concave portion 57 for maintaining the hinged top door 14 in a closed position (see FIG. 3). The latch 44 preferably has a bifurcated triangular shape with a downwardly slanted bottom surface 47 that will abut the second semi-concave portion 57 to move the latch 44 rearward as the hinged top door 14 is moved to the closed position, thereby allowing the hinged top door 14 to close. It is contemplated, however, that the second semi-concave portion 57 of the housing 12 could have a downwardly slanted top surface instead of the surface being located on the latch 44, or that both the hinged top door 14 and the latch 44 could have mating slanted surfaces performing the same function as described directly above. The first semi-concave portion 40 of the hinged top door 14 and the second semi-concave portion 57 of the housing 12 are aligned to form an interrupted concave surface. Once the hinged top door 14 is in the closed position, the resilient material of the U-shaped spring actuated locking mechanism 30 will bias the latch 44 forward, thereby forcing the latch 44 underneath the second semi-concave portion 57 to secure the hinged top door 14 in the closed position. The hinged top door 14 is thereafter opened by pressing rearward on the thumb tab 42 of the U-shaped spring actuated locking mechanism 30 to remove the latch 44 from underneath the bottom surface 45 of the second semi-concave portion 57, thereby allowing the hinged top door 14 to rotate upwards.

The circuit allowing the lamp 22 to be lit is closed by rotating the hinged top door 14 into the closed position (FIG. 3), wherein the cam 20 abuts against the adjacent battery and forces the batteries forward into contact with a fourth electrical leaf spring contact 110 of the lamp holder 18. Therefore, when the hinged top door 14 is in the closed position, the batteries will contact the fourth electrical leaf spring contact 110 on the lamp holder 18 and the first electrical contact strip 54 on the cam 20 of the hinged top door 14. Additionally, as described in more detail below, the third electrical contact 55 of the housing 12 abuts against a fifth electrical contact 118 of the lamp holder 18. Therefore, when the hinged top door 14 is in the closed position, an electrical circuit is provided such that the batteries can operate the lamp 22 in the lamp holder 18 in response to actuation of trigger 26.

The illustrated lamp holder 18 (FIGS. 1,2 and 9–12) is manually inserted into and removed from the lamp enclosure 28 through the interior cavity 46 of the housing 12. The lamp holder 18 includes a cylindrical body 100 having a receptacle 106 at a front end of the body 100 for receiving the lamp 22. The lamp 22 includes a bulb 108 and a base contact 112 connected to the bulb 108. The lamp 22 also includes a filament and connecting and supporting wires as is known to those well skilled in the art. The base contact 112 is inserted into the receptacle 106 of the body 100 for connecting the lamp 22 to the body 100. The cylindrical body 100 of the lamp holder 18 includes the fourth electrical leaf spring contact 110 extending from a rear end of the cylindrical body 100. The fourth electrical leaf spring contact 110 extends from the rear of the body 100, through a back wall of the body 100 and into the receptacle 106 in the lamp holder 18. The fourth electrical leaf spring contact 110 abuts the base contact 112 of the lamp 22 when the base contact 112 of the lamp 22 is inserted into the opening 106 in the body 100. The fourth electrical leaf spring contact 110 electrically connects the batteries to the base contact 112 of the lamp 22 when the hinged top door 14 is in the closed position. The cylindrical body 100 of the lamp holder 18 also includes the fifth electrical contact 118 extending below the cylindrical body 100, along a bottom of the body 100 and into the receptacle 106 of the body 100. The fifth electrical contact 118 also abuts the base contact 112 of the lamp 22 when the base contact 112 of the lamp 22 is inserted into the receptacle 106 of the body 100. As described in more detail below, the fifth electrical contact 118 electrically connects the third electrical contact 55 of the housing 12 to the base contact 112 of the lamp 22 when the hinged top door 14 is in the closed position.

In the illustrated example, the lamp holder 18 also includes a horseshoe shaped abutment flange 130 extending from a periphery of the body 100. The abutment flange 130 includes a track 102 located on each side of the cylindrical body 100. The tracks 102 have a U-shaped cross section and are used to properly insert the lamp holder 18 into the housing 12 of the light device 10. As seen in FIGS. 7 and 8, the housing 12 includes a pair of guides 120 extending from inside walls of the internal cavity 46 of the housing 12 at a position behind the central opening 34 in the interior portion 36 of the lamp enclosure 28. The pair of guides 120 are preferably located on a plane extending radially from the central opening 34.

The illustrated lamp holder 18 is connected to the housing 12 of the light device 10 by inserting the lamp holder 18 into the internal cavity 46 of the housing 12 and by inserting the bulb 110 of the lamp 22 and a front portion of the cylindrical body 100 in front of the abutment flange 130 into the central opening 34 in the internal portion 36 of the lamp enclosure 28 until the abutment flange 130 of the lamp holder 18 contacts a rim of the tubular portion 27 of the lamp enclosure 28. As the bulb 110 of the lamp 22 is being inserted into the central opening 34 in the inter portion 36 of the lamp enclosure 28, the guides 120 will slide within the tracks 102 of the lamp holder 18, thereby maintaining the lamp holder 18 in the proper position. It is contemplated, however, that the housing 12 could have the tracks 102 and the lamp holder 18 could include the guides 120. Once the lamp holder 18 is placed within the housing 12 of the light device 10, the fifth electrical contact 118 will contact the third electrical contact 55 of the housing 12. The guides 120 preferably include an off-set flange 122 in the middle of the guides 120 having a semi-circular flange 123 extending from a bottom surface thereof. The semi-circular flanges 123 will snap lock against an end of the tracks 102 of the lamp holder 18 to maintain the lamp holder 18 within the housing 12 when the lamp 22 is fully inserted into the lamp enclosure 28. The semi-circular flanges 123 will move upward as the lamp 22 is pulled out of the lamp enclosure 28, thereby allowing the lamp housing 18 to be removed from the housing 12. The lamp holder 18 also preferably includes a fin shaped gripping flange 104 extending upwardly from a top of the cylindrical body 100. The gripping flange 104 assists in inserting and removing the lamp holder 18 from the housing 12.

The light device 10 of the present invention therefore includes an ergonomically shaped housing 12 and top door 14 with easy and intuitive lamp 22 and battery access. As the hinged top door 14 is opened, the spring pressure that holds the batteries in tight contact front to back is released, aiding the ease to which the batteries can be loaded and unloaded. Additionally, as the hinged top door 14 is closed, the spring force is re-applied to the batteries. The lamp 22 is also preferably accessed through the hinged top door 14. The lamp holder 18 allows a user of the light device 10 to remove the lamp 22 and the lamp holder 18 without having to open the front of the housing 12 or thread off a contact shell.

It will be readily appreciated by those skilled in the art that modifications may be made to the invention without departing from the concepts disclosed herein. For example, it is contemplated that the light device could include the removable lamp holder 18 within the housing 12, but not include the cam 20 on the top door 14 or a door fixedly connected to the housing 12. Additionally, it is contemplated that the light device could have the cam 20 on the top door 14, but not include the removable lamp holder 18. Such modifications are to be considered as included in the following claims, unless these claims by their language expressly state otherwise.

We claim:

1. A light device comprising:

a battery housing defining an interior space adapted to accept batteries, the housing being adapted to accept a lamp;

a door pivotally connected to the battery housing, the door having an open position allowing access to the interior space of the battery housing and a closed position for enclosing the interior space of the battery housing, the door including an electrical cam;

wherein the electrical cam is configured to contact batteries in the battery housing when the door is pivoted to the closed position to thereby create a circuit for powering the lamp and move away from batteries in the battery housing when the door is pivoted to the open position to thereby allow the batteries to be removed from the interior space of the battery housing;

wherein the door includes a palm surface and the battery housing includes a grip surface and a trigger detent, with the trigger detent being located between the grip surface and the first end of the battery housing, thereby ergonomically accepting a hand of a user of the light device with fingers of a user of the light device on the grip surface and a palm of the user enclosed around the palm surface of the hinged top door; and wherein the trigger detent is configured to allow a user of the light device to readily actuate the trigger detent with an index finger of the user to thereby alternatively turn the lamp on and off by closing and opening, respectively, a circuit between the lamp and the batteries.

2. A light device comprising:

a battery housing defining an interior space adapted to accept batteries, the housing being adapted to accept a lamp, the battery housing includes a cover and a reflector fixed to the battery housing, the cover allowing light to at least partially pass therethrough;

a door pivotally connected to the battery housing, the door having an open position allowing access to the interior space of the battery housing and a closed position for enclosing the interior space of the battery housing, the door including an electrical cam;

wherein the electrical cam is configured to contact batteries in the battery housing when the door is pivoted to the closed position to thereby create a circuit for powering the lamp and move away from batteries in the battery housing when the door is pivoted to the open position to thereby allow the batteries to be removed from the interior space of the battery housing;

further including a lamp holder adapted to retain the lamp, the lamp bolder being removably connected to the battery housing within the interior space of the battery housing, the lamp holder is configured to be positioned adjacent the reflector of the lamp enclosure when in the battery housing;

wherein the lamp holder is accessible from the interior space of the battery housing, thereby allowing the lamp to be removed from the battery housing when the door is in the open position.

3. The light device of claim 2, wherein:

the electrical cam is a first contact of a circuit between the lamp and the batteries, with the cam being configured to engage the batteries when the door is in the closed position;

the battery housing includes a second contact configured to engage the electrical cam when the door is in the closed position;

the battery housing also includes a third contact adjacent the lamp holder when the lamp holder is connected to the battery housing;

the lamp holder includes a fourth contact configured to engage the batteries and a contact of the lamp when the door is in the closed position and when the lamp holder is connected to the battery housing; and the lamp holder further includes a fifth contact configured to engage the third contact and the lamp when the door is in the closed position and when the lamp holder is connected to the battery housing;

thereby creating the circuit between the lamp and the batteries.

4. The light device of claim 3, wherein:

the lamp holder includes a track; and the battery housing includes a guide configured to be inserted into the track of the lamp holder when the lamp holder is connected to the battery housing.

5. The light device of claim 4, wherein:

the lamp holder includes a gripping flange to assist in inserting and removing the lamp holder from the battery housing.

6. A light device comprising:

a battery housing defining an interior space adapted to accept batteries, the housing being adapted to accept a lamp;

a door pivotally connected to the battery housing, the door having an open position allowing access to the interior space of the battery housing and a closed position for enclosing the interior space of the battery housing, the door including an electrical cam;

wherein the electrical cam is configured to contact batteries in the battery housing when the door is pivoted to the closed position to thereby create a circuit for powering the lamp and move away from batteries in the battery housing when the door is pivoted to the open position to thereby allow the batteries to be removed from the interior space of the battery housing;

wherein the battery housing includes a pair of struts located at an end of the battery housing;

wherein the door includes a pivot leg located between the pair of struts of the battery housing; and wherein a pivot pin extends through the struts of the battery housing and the pivot leg of the door to pivotally connect the door to the battery housing.

7. The light device of claim 6, wherein:

the electrical cam is located on the pivot leg of the door.

8. The light device of claim 7, wherein:

the door includes a spring locking device having a latch and a tab;

the latch includes a top surface and a bottom surface;

the top surface of the latch is configured to abut against a bottom surface of the battery housing to maintain the door in the closed position; and a user of the light device can pull on the tab to remove the latch from underneath the bottom surface of the battery housing, thereby allowing the door to move to the open position.

9. The light device of claim 8, wherein:

at least one of the bottom surfaces of the latch of the spring locking device and a top surface of the housing is slanted surface, thereby moving the latch away from the housing as the door is moved to the closed position and allowing the door to close.

10. A light device comprising:

a housing including a cavity configured to retain batteries therein, the housing further including a lamp holder configured to retain a lamp; and a hinged top door connected to the housing, the hinged top door including an open position for allowing access to the cavity and a closed position for enclosing the cavity;

the hinged top door including a cam adapted to hold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder; and wherein the cam is configured to move away from the batteries as the hinged top door is moved to the open position, thereby releasing the tension holding the batteries in place within the housing and allowing the batteries to be easily loaded and unloaded;

wherein the hinged top door includes a palm surface and the housing includes a grip surface and a trigger detent, with the trigger detent being located between the grip surface and the first end of the housing, thereby ergonomically accepting a hand of a user of the light device with fingers of a user of the light device on the grip surface and a palm of the user enclosed around the palm surface of the hinged top hinged top door; and wherein the trigger detent is configured to allow a user of the light device to readily actuate the trigger detent with an index finger of the user to thereby alternatively turn the lamp on and off by closing and opening, respectively, a circuit between the lamp and the batteries.

11. A light device comprising:

a housing including a cavity configured to retain batteries therein, the housing includes a cover and a reflector fixed to the housing, the cover allowing light to at least partially pass therethrough; the housing further including a lamp holder configured and adapted to retain a lamp, the lamp holder is configured to be positioned adjacent the reflector of the lamp enclosure when in the housing;

a hinged top door connected to the housing, the hinged top door including an open position for allowing access to the cavity and a closed position for enclosing the cavity;

the hinged top door including a cam adapted to hold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder; and wherein the cam is configured to move away from the batteries as the hinged top door is moved to the open position, thereby releasing the tension holding the batteries in place within the housing and allowing the batteries to be easily loaded and unloaded;

the lamp holder being removably connected to the housing within the cavity of the housing;

wherein the lamp holder is accessible from the cavity of the housing, thereby allowing the lamp to be removed from the housing when the hinged top door is in the open position.

12. The light device of claim 11, wherein:

the electrical cam is a first contact of a circuit between the lamp and the batteries, with the cam being configured to engage the batteries when the hinged top door is in the closed position;

the housing includes a second contact configured to engage the electrical cam when the hinged top door is in the closed position;

the housing also includes a third contact adjacent the lamp holder when the lamp holder is connected to the housing;

the lamp holder includes a fourth contact configured to engage the batteries and a contact of the lamp when the hinged top door is in the closed position and when the lamp holder is connected to the housing; and the lamp holder further includes a fifth contact configured to engage the third contact and the lamp when the hinged top door is in the closed position and when the lamp holder is connected to the housing;

thereby creating the circuit between the lamp and the batteries.

13. The light device of claim 12, wherein:

the lamp holder includes a track; and the housing includes a guide configured to be inserted into the track of the lamp holder when the lamp holder is connected to the housing.

14. The light device of claim 13, wherein:

the lamp holder includes a gripping flange to assist in inserting and removing the lamp holder from the housing.

15. A light device comprising:

a housing including a cavity configured to retain batteries therein, to housing further including a lamp holder configured to retain a lamp; and a hinged top door connected to the housing, the hinged top door including an open position for allowing access to the cavity and a closed position for enclosing the cavity;

the hinged top door including a cam adapted to bold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder; and wherein the cam is configured to move away from the batteries as the hinged top door is moved to the open position, thereby releasing the tension holding the batteries in place within the housing and allowing the batteries to be easily loaded and unloaded;

wherein the housing includes a pair of struts located at an end of the housing;

wherein the hinged top door includes a pivot leg located between the pair of struts of the housing; and wherein a pivot pin extends through the struts of the housing and the pivot leg of the hinged top door to pivotally connect the hinged top door to the housing.

16. The light device of claim 15, wherein:

the electrical cam is located on the pivot leg of the hinged top door.

17. The light device of claim 15, wherein:

the hinged top door includes a spring locking device having a latch and a tab;

the latch includes a top surface and a bottom surface;

the top surface of the latch is configured to abut against a bottom surface of the housing to maintain the hinged top door in the closed position; and a user of the light device can pull on the tab to remove the latch from underneath the bottom surface of the housing, thereby allowing the hinged top door to move to the open position.

18. The light device of claim 17, wherein:

at least one of the bottom surfaces of the latch of the spring locking device and a top surface of the housing is slanted surface, thereby moving the latch away from the housing as the hinged top door is moved to the closed position and allowing the hinged top door to close.

19. A light device comprising:

a housing defining an interior space adapted to accept batteries;

a cover fixed to the housing, the cover allowing light to at least partially pass therethrough;

a reflector fixed to the housing;

a lamp holder adapted to retain a lamp, the lamp holder being removably connected to the housing within the interior space of the housing and being configured to be positioned adjacent the reflector of the lamp enclosure when in the housing to position the lamp between the reflector and the lens;

a door having an open position allowing access to the interior space of the housing and a closed position for enclosing the interior space of the housing;

wherein the lamp holder is accessible from the interior space of the housing, thereby allowing the lamp to be removed from the housing when the door is in the open position.

20. The light device of claim 19, wherein:

the door includes an electrical cam;

the electrical cam is configured to contact batteries in the housing when the door is pivoted to the closed position, thereby pushing the batteries into contact with the lamp holder and creating a circuit for powering the lamp; and the electrical cam is also configured to move away from batteries in the housing when the door is pivoted to the open position to thereby allow the batteries to be removed from the interior space of the housing.

21. The light device of claim 20, wherein:

the electrical cam is a first contact of a circuit between the lamp and the batteries, with the cam being configured to engage the batteries when the door is in the closed position;

the housing includes a second contact configured to engage the electrical cam when the door is in the closed position;

the housing also includes a third contact adjacent the lamp holder when the lamp holder is connected to the housing;

the lamp holder includes a fourth contact configured to engage the batteries and a contact of the lamp when the door is in the closed position and when the lamp holder is connected to the housing; and the lamp holder further includes a fifth contact configured to engage the third contact and the lamp when the door is in the closed position and when the lamp holder is connected to the housing;

thereby creating the circuit between the lamp and the batteries.

22. The light device of claim 21, wherein:

the lamp holder includes a track; and the housing includes a guide configured to be inserted into the track of the lamp holder when the lamp holder is connected to the housing.

23. The light device of claim 22, wherein:

the lamp holder includes a gripping flange to assist in inserting and removing the lamp holder from the housing.

24. The light device of claim 23, wherein:

the housing includes a pair of struts located at an end of the housing;

the door includes a pivot leg located between the pair of struts of the housing; and a pivot pin extends through the struts of the housing and the pivot leg of the door to pivotally connect the door to the housing.

25. The light device of claim 24, wherein:

the electrical cam is located on the pivot leg of the door.

26. The light device of claim 19, wherein:

the door includes a spring locking device having a latch and a tab;

the latch includes a top surface and a bottom surface;

the top surface of the latch is configured to abut against a bottom surface of the housing to maintain the door in the closed position; and a user of the light device can pull on the tab to remove the latch from underneath the bottom surface of the housing, thereby allowing the door to move to the open position.

27. The light device of claim 26, wherein:

at least one of the bottom surface of the latch of the spring locking device and a top surface of the housing is slanted surface, thereby moving the latch away from the housing as the door is moved to the closed position and allowing the door to close.

28. A light device comprising:

a housing including a cavity configured to retain batteries therein, the housing further including a lamp holder configured to retain a lamp; and a hinged top door connected to the housing, the hinged top door including an open position for allowing access to the cavity and a closed position for enclosing the cavity;

the hinged top door including a cam adapted to hold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder; and wherein the cam is configured to move away from the batteries as the hinged top door is moved to the open position, thereby releasing the tension holding the batteries in place within the housing and allowing the batteries to be easily loaded and unloaded;

wherein the hinged top door includes a spring locking device having a latch and a tab;

wherein the latch includes a top surface and a bottom surface;

wherein the top surface of the latch is configured to abut against a bottom surface of the housing to maintain the hinged top door in the closed position;

wherein a user of the light device can pull on the tab to remove the latch from underneath the bottom surface of the housing, thereby allowing the hinged top door to move to the open position;

wherein the door includes a palm surface and the housing includes a grip surface and a trigger detent, with the trigger detent being located between the grip surface and the first end of the housing, thereby ergonomically accepting a hand of a user of the light device with fingers of a user of the light device on the grip surface and a palm of the user enclosed around the palm surface of the hinged top door; and wherein the trigger detent is configured to allow a user of the light device to readily actuate the trigger detent with an index finger of the user to thereby alternatively turn the lamp on and off by closing and opening, respectively, a circuit between the lamp and the batteries.

29. A light device comprising:

a housing having a first end, a second end and a U-shaped bottom extending between the first end and the second end, the first end, second end and U-shaped bottom defining an interior space adapted to accept batteries, the housing including a reflector and a cover at the first end, the housing being configured to accept a lamp between the cover and the reflector;

a hinged top door pivotally connected to the housing and being configured to enclose the batteries within the interior space, the hinged top door including an open position for allowing access to the cavity and a closed position for enclosing the cavity;

wherein the hinged top door includes a palm surface and the housing includes a grip surface and a trigger detent, wit the trigger detent being located between the grip surface and the first end of the housing, thereby ergonomically accepting a hand of a user of the light device with fingers of a user of the light device on the grip surface and a palm of the user enclosed around the palm surface of the hinged top door, and wherein the trigger detent is configured to allow a user of the light device to readily actuate the trigger detent with an index finger of the user to thereby alternatively turn the lamp on and off by closing and opening, respectively, a circuit between the lamp and the batteries.

30. The light device of claim 29, wherein:

the hinged top door includes an electrical cam;

the electrical cam is configured to contact batteries in the housing when the hinged top door is pivoted to the closed position; and the electrical cam is also configured to move away from batteries in the housing when the door is pivoted to the open position to thereby allow the batteries to be removed from the interior space of the housing.

31. The light device of claim 29, further including:

a lamp holder adapted to retain the lamp, the lamp holder being removably connected to the housing within the interior space of the housing;

wherein the lamp holder is accessible from the interior space of the housing, thereby allowing the lamp to be removed from the housing when the hinged top door is in the open position.

32. The light device of claim 31, wherein:

the housing includes a cover and a reflector fixed to the housing, the cover allowing light to at least partially pass therethrough; and the lamp holder is configured to be positioned adjacent the reflector of the lamp enclosure when in the housing to position the lamp between the reflector and the lens.

33. The light device of claim 32, wherein:

the electrical cam is a first contact of a circuit between the lamp and the batteries, with the cam being configured to engage to batteries when the hinged top door is in the closed position;

the housing includes a second contact configured to engage the electrical cam when the hinged top door is in the closed position;

the housing also includes a third contact adjacent the lamp holder when the lamp holder is connected to the housing;

the lamp holder includes a fourth contact configured to engage the batteries and a contact of the lamp when the hinged top door is in the closed position and when the lamp holder is connected to the housing; and the lamp holder further includes a fifth contact configured to engage the third contact and the lamp when the hinged top door is in the closed position and when the lamp holder is connected to the housing;

thereby creating the circuit between the lamp and the batteries.

34. The light device of claim 33, wherein:

the lamp holder includes a track; and the housing includes a guide configured to be inserted into the track of the lamp holder when the lamp holder is connected to the housing.

35. The light device of claim 34, wherein:

the lamp holder includes a gripping flange to assist in inserting and removing the lamp holder from the housing.

36. The light device of claim 35, wherein:

the housing includes a pair a struts located at an end of the housing;

the hinged top door includes a pivot leg located between the pair of struts of the housing; and a pivot pin extends through the struts of the housing and the pivot leg of the hinged top door to pivotally connect the hinged top door to the housing.

37. The light device of claim 36, wherein:

the electrical cam is located on the pivot leg of the hinged top door.

38. The light device of claim 29 wherein:

the hinged lop door includes a spring locking device having a latch and a tab;

the latch includes a top surface and a bottom surface;

the top surface of the latch is configured to abut against a bottom surface of the housing to maintain the hinged top door in the closed position; and a user of the light device can pull on the tab to remove the latch from underneath the bottom surface of the housing, thereby allowing the hinged top door to move to the open position.

39. The light device of claim 38, wherein:

at least one of the bottom surface of the latch of the spring locking device and a top surface of the housing is a slanted surface, thereby moving the latch away from the housing as the hinged top door is moved to the closed position and allowing the hinged top door to close.

40. The light device of claim 29, further including:

a lamp holder adapted to retain a lamp, the lamp holder being removably connected to the housing within the interior space of the housing and being configured to be positioned adjacent the reflector of the lamp enclosure when in the housing to position the lamp between the reflector and the lens;

wherein the lamp holder is accessible from the interior space of the housing, thereby allowing the lamp to be removed from the housing when the door is in the open position.

41. A light device comprising:

a battery housing defining an interior space adapted to accept batteries, the housing being adapted to accept a lamp; and a door pivotally connected to the battery housing, the door having an open position allowing access to the interior space of the battery housing and a closed position for enclosing the interior space of the battery housing, the door including an electrical cam;

wherein the electrical cam is configured to contact batteries in the battery housing when the door is pivoted to the closed position to thereby create a circuit for powering the lamp and move away from batteries in the battery housing when the door is pivoted to the open position to thereby allow the batteries to be removed from the interior space of the battery housing; and wherein the battery housing includes a front portion configured to hold the lamp and a rear portion, and the door is pivotally connected to the rear portion of the battery housing.

42. The light device of claim 41, further including:

a lamp holder adapted to retain the lamp, the lamp holder being removably connected to the battery housing within the interior space of the battery housing;

wherein the lamp holder is accessible from the interior space of the battery housing, thereby allowing the lamp to be removed from the battery housing when the door is in the open position.

43. The light device of claim 42, wherein:

the battery housing includes a cover and a reflector fixed to the battery housing, the cover allowing light to at least partially pass therethrough; and the lamp holder is configured to be positioned adjacent the reflector of the lamp enclosure when in the battery housing to position the lamp between the reflector and the lens.

44. A light device comprising:

a battery housing defining an interior space adapted to accept batteries, the housing being adapted to accept a lamp;

a door pivotally connected to the battery housing, the door having an open position allowing access to the interior space of the battery housing and a closed position for enclosing the interior space of the battery housing, the door including an electrical cam and a spring locking device having a latch and a tab, the latch includes a top surface and a bottom surface, the top surface of the latch is configured to abut against a bottom surface of the battery housing to maintain the door in the closed position; and a user of the light device can pull on the tab to remove the latch from underneath the bottom surface of the battery housing, thereby allowing the door to move to the open position;

wherein the electrical cam is configured to contact batteries in the battery housing when the door is pivoted to the closed position to thereby create a circuit for powering the lamp and move away from batteries in the battery housing when the door is pivoted to the open position to thereby allow the batteries to be removed from the interior space of the battery housing; and wherein an electrical circuit is completed between the batteries, the lamp, the electrical cam and an electrical circuit in the battery housing when the door is pivoted to the closed position.

45. The light device of claim 44, wherein:

at least one of the bottom surfaces of the latch of the spring locking device and a top surface of the housing is slanted surface, thereby moving the latch away from the housing as the door is moved to the closed position and allowing the door to close.

46. A light device comprising:

a housing including a cavity configured to retain batteries therein, the housing further including a lamp holder configured to retain a lamp; and a hinged top door connected to the housing, the hinged top door including an open position for allowing access to the cavity and a closed position for enclosing the cavity the hinged top door including a cam adapted to hold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder;

wherein the cam is configured to move away from the batteries as the hinged top door is moved to the open position, thereby releasing the tension holding the batteries in place within the housing and allowing the batteries to be easily loaded and unloaded; and wherein the battery housing includes a front portion configured to hold the lamp and a rear portion, and the door is pivotally connected to the rear portion of the battery housing.

47. The light device of claim 46, further including:

a lamp holder adapted to retain the lamp, the lamp holder being removably connected to the housing within the cavity of the housing;

wherein the lamp holder is accessible from the cavity of the housing, thereby allowing the lamp to be removed from the housing when the hinged top door is in the open position.

48. The light device of claim 47, wherein:

the housing includes a cover and a reflector fixed to the housing, the cover allowing light to at least partially pass therethrough; and the lamp holder is configured to be positioned adjacent the reflector of the lamp enclosure when in the housing.

49. A light device comprising:

a housing including a cavity configured to retain batteries therein, the housing further including a lamp holder configured to retain a lamp; and a hinged top door connected to the housing, the hinged top door including an open position for allowing access to the cavity and a closed position for enclosing the cavity, the hinged top door includes a spring locking device having a latch and a tab, the latch includes a top surface and a bottom surface, the top surface of the latch is configured to abut against a bottom surface of the housing to maintain the hinged top door in the closed position, a user of the light device can pull on the tab to remove the latch from underneath the bottom surface of the housing, thereby allowing the hinged top door to move to the open position;

the hinged top door including a cam adapted to hold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder;

wherein the cam is configured to move away from the batteries as the hinged top door is moved to the open position, thereby releasing the tension holding the batteries in place within the housing and allowing the batteries to be easily loaded and unloaded; and wherein an electrical circuit is completed between the batteries, the lamp, the electrical cam and an electrical circuit in the battery housing when the door is pivoted to the closed position.

50. The light device of claim 49, wherein:

at least one of the bottom surfaces of the latch of the spring locking device and a top surface of the housing is slanted surface, thereby moving the latch away from the housing as the hinged top door is moved to the closed position and allowing the hinged top door to close.

51. A light device comprising:

a housing including a cavity configured to retain batteries therein, the housing further including a lamp holder configured to retain a lamp, the housing includes a cover and a reflector fixed to the housing, the cover allowing light to at least partially pass therethrough, the lamp holder being removably connected to the housing within the cavity of the housing; and a hinged top door connected to the housing, the hinged top door including an open position for allowing access to the cavity and a closed position for enclosing the cavity, wherein the lamp holder is accessible from the cavity of the housing, thereby allowing the lamp to be removed from the housing when the hinged top door is in the open position, the lamp holder is configured to be positioned adjacent the reflector of the lamp enclosure when in the housing;

the hinged top door including a cam adapted to hold batteries in the cavity in tight contact with the lamp holder when the hinged top door is in the closed position;

wherein the cam is configured to move towards the batteries as the hinged top door is moved to the closed position, thereby applying tension to the batteries to hold the batteries in place to create a circuit for powering the lamp engaged with the lamp holder;

wherein the cam is configured to move away from the batteries as the hinged top door is moved to the open position, thereby releasing the tension holding the batteries in place within the housing and allowing the batteries to be easily loaded and unloaded; and wherein an electrical circuit is completed between the batteries, the lamp, the electrical cam and an electrical circuit in the battery housing when the door is pivoted to the closed position.

52. A light device comprising:

a housing defining an interior space adapted to accept batteries;

a cover fixed to the housing, the cover allowing light to at least partially pass therethrough;

a reflector fixed to the housing;

a lamp holder adapted to retain a lamp, the lamp holder being removably connected to the housing within the interior space of the housing and being configured to be positioned adjacent the reflector of the lamp enclosure when in the housing to position the lamp between the reflector and the lens;

a door having an open position allowing access to the interior space of the housing and a closed position for enclosing the interior space of the housing, wherein the door includes a palm surface and the housing includes a grip surface and a trigger detent, with the trigger detent being located between the grip surface and the first end of the housing, thereby ergonomically accepting a hand of a user of the light device with fingers of a user of the light device on the grip surface and a palm of the user enclosed around the palm surface of the hinged top door; and the trigger detent is configured to allow a user of the light device to readily actuate the trigger detent with an index finger of the user to thereby alternatively turn the lamp on and off by closing and opening, respectively, a circuit between the lamp and the batteries;

wherein the lamp holder is accessible from the interior space of the housing, thereby allowing the lamp to be removed from the housing when the door is in the open position.

* * * * *